US006159544A

United States Patent [19]

Liu et al.

[11] Patent Number: 6,159,544

[45] Date of Patent: Dec. 12, 2000

[54] APPARATUS AND METHOD FOR FORMING A COATING LAYER OF MULTIPLE STRIPES

[75] Inventors: Ta-Jo Liu; Yun-Wey Yu, both of Hsinchu, Taiwan

[73] Assignee: National Science Council, Taipei, Taiwan

[21] Appl. No.: 09/323,315

[22] Filed: Jun. 1, 1999

[30] Foreign Application Priority Data

Nov. 9, 1998 [TW] Taiwan ..... 87118645

[51] Int. Cl.[7] ..... B05D 1/26; B05C 5/02

[52] U.S. Cl. ..... 427/286; 427/420; 118/407; 118/412; 118/DIG. 4

[58] Field of Search ..... 427/286, 420; 118/407, 412, DIG. 4

[56] References Cited

U.S. PATENT DOCUMENTS

| | | | |
|---|---|---|---|
| 4,106,437 | 8/1978 | Bartlett | 118/412 |
| 4,324,816 | 4/1982 | Landis et al. | 427/128 |
| 4,344,990 | 8/1982 | Wollam et al. . | |
| 5,145,528 | 9/1992 | Watanabe et al. . | |
| 5,614,260 | 3/1997 | Darcy . | |
| 5,733,608 | 3/1998 | Kessel et al. . | |

FOREIGN PATENT DOCUMENTS

| | | |
|---|---|---|
| 7-136568 | 5/1995 | Japan . |
| 7-195015 | 8/1995 | Japan . |
| 8-038972 | 2/1996 | Japan . |
| 8-099056 | 4/1996 | Japan . |

*Primary Examiner*—Fred J. Parker
*Attorney, Agent, or Firm*—Jackson Walker, L.L.P.

[57] ABSTRACT

This invention is related to a die set and method for the production of multiple stripes with two different materials A and B adjacent to each other. The special feature of this invention is that a specially designed shim is inserted between two pieces of coating dies. When liquids A and B enter the two sides of the die set separately, B liquid will flow through the distribution passages in the shim to form multiple stripes and then contact stripes of A liquid in the same slot section. The multiple stripes of repeated coating liquids that consists of ABAB patterns will be generated once the multiple stripes are coated and dried on the substrate.

7 Claims, 5 Drawing Sheets

APPARATUS AND METHOD FOR FORMING A COATING LAYER OF MULTIPLE STRIPES

BACKGROUND OF THE INVENTION

1. Field of the Invention

The present invention relates to an apparatus and a method for forming a coating layer, particularly to a die set and a method for forming a coating layer of multiple stripes composed of two materials A and B adjacent to each other in a repeated ABAB pattern.

2. Description of Related Art

U.S. Pat. No. 4,106,437 discloses an apparatus for multiple stripe coating of a web with liquid coating composition which is comprised of a hopper having a pair of spaced lips and a pair of shims mounted in face-to-face arrangement within the hopper and positioned between the spaced lips. One of the shims is provided with a plurality of open-ended channels while the second shim is equipped with a plurality of projecting portions, corresponding in width and location to the desired stripes, which are in alignment with the open-ended channels and project beyond the open ends thereof. The apparatus is capable of carrying out multiple stripe coating of a web at high speeds and with a high degree of precision in regard to stripe width and registration.

U.S. Pat. No. 4,324,816 discloses extrudable materials which exhibit a decrease in viscosity as the shear rate is increased, such as magnetic dispersion striping materials, and are suitable for extrusion coating in the form of a narrow stripe. The stripe has predetermined uniform cross-sectional dimensions including substantially uniform thickness, and is coated onto a moving web by means of a die maintained in a predetermined spaced relation with the web. The die has two or more bores through which the extrudable material is extruded in columns onto the moving web to form the stripe thereon.

Japanese patent publication No. 7-136568 A discloses a method for simultaneously forming continuous coating surfaces of the same thickness free from joints in the transverse direction of a band-shaped material by segmenting a coating liquid passage consisting of manifold parts and a slit part in a transverse direction and supplying different kinds of coating liquids in the respective segmented passages.

Japanese patent publication No. 7-195015 A discloses methods for producing multiple stripe coating product. To easily control the coating width of a coating solution and to make accurate stripe coating possible, a liquid-permeable sheet is placed in a slot of a coating die to discharge a coating solution.

Japanese patent publication No. 8-038972 A discloses methods for producing multiple stripe coating product, in which continuously coating a stripe pattern consisting of plural colors on a belt-like material with one coating process and also easily changing the width of a stripe are made possible. A manifold is provided in the inside of a metallic material apart from a slot part for discharging a coating material. A plurality of through-holes communicated with the slot part, and a plurality of coating liquid feed-ports communicated with a coating liquid feed device at the outside of a die main body are formed on the manifold.

Japanese patent publication No. 8-099056 A discloses methods for forming a coating film in a stripe pattern with no fluctuation width and thickness by projecting a front block more than a back block toward a base material and forming jetting-out holes for a coating material in the flat face of the back block. In this prior art, a nozzle is composed of a front block positioned in the upper stream side in a base material running direction and a back block positioned in the down stream side. The front block of the nozzle is projected toward the base material side as compared with the back block. When a base material is moved along the surface of the nozzle composed in this way, the base material moves along the curved face of the front block and continuously moves above the back block of the nozzle in which jetting-out holes for a coating material are formed. Consequently, a coating film in a stripe pattern with no fluctuation of width is formed on the surface of the base material by coating.

When a coating product of multiple stripes is made, interfaces of different coating solutions will be affected by coating thickness thereof and physical properties of coating solutions, such as the viscosity and the surface tension. These will result in a tendency that the borders of the coating solutions extend outward and become thin, and thus a coating layer of inferior uniformity and low interfacial quality is formed. The problems become worse, if the multiple stripe coating layer is laid as an intermediate layer of multiple layer coating product. Therefore, a technique of precise multiple stripe coating in ABAB pattern becomes essentially important, due to a necessity of extreme uniformity and an approximately rectangular cross section for the multiple stripe coating layer.

In the aforesaid prior art methods for forming a coating in an ABAB pattern, it is difficult to ensure a definite and precise interface between two adjacent coating solutions A, B and even harder to generate an intermediate layer of multiple stripe in a multiple coating layer structure. Among them Japanese patent publication Nos. 7-136568, 8-038972 and 8-099056 have great disadvantages in non-uniform width of stripes and ambiguous interfaces of coating solutions A, B, because the two coating solutions are contacted with each other outside the die set.

SUMMARY OF THE INVENTION

An object of the present invention is to provide a device and a method for forming a coating layer of multi-stripe, in which a specially designed shim is inserted between two overlapping dies to generate multiple stripes of repeated coating liquids composed of two materials A and B adjacent to each other in an alternating ABAB pattern with distinct interfaces between adjacent strips of two coating liquids A and B which are contacted with each other in the dies without deformation.

In order to accomplish the object of the present invention a die set for forming multiple stripes of repeated coating liquids composed of two materials A and B adjacent to each other constructed according to the present invention comprises:

- an upper die having a first groove formed on a lower horizontal plane thereof, and a first inlet hole formed at a location other than said lower horizontal plane thereof for introducing said liquid A from outside into said first groove;
- an inverted U-shaped upper shim having a first thickness;
- an inverted U-shaped lower shim having a second thickness;
- a guide shim having an upper side and a lower side, which are parallel to a horizontal plane, further comprising
  - a plurality of spaced first flow distribution blocks, projecting from said upper side by a first distance that is equal to said first thickness of said upper shim, each of said plurality of first flow distribution blocks being of an inverted U shape with a head and two legs, a second flow distribution block projecting from said lower side of said guide shim by a second distance that is equal to said second thickness of said lower shim, and a plurality of distribution passages, each of said plurality of distribution passages connecting said lower side and said upper side of said guide shim, and an outlet of said distribution passage being located between said two legs of said first flow distribution block and an inlet of said distribution passage being adjacent to said second flow distribution block; and a lower die having a second groove formed on an upper horizontal plane thereof, and a second inlet hole formed at a location other than said upper horizontal plane thereof for introducing said liquid B from outside into said second groove;

wherein said upper die, said upper shim, said guide shim, said lower shim and said lower die are assembled in sequence, so that said upper shim is between said lower horizontal plane of said upper die and said upper side of said guide shim, and said lower shim is between said upper horizontal plane of said lower die and said lower side of said guide shim; wherein said first groove of said upper die and said plurality of first flow distribution blocks are enclosed by said inverted U-shaped upper shim, and said second groove of said lower die is enclosed by said inverted U-shaped lower shim; wherein openings of said inverted U shapes of said plurality of first flow distribution blocks face toward to a same direction of opening of said inverted U-shaped upper shim, and said second flow distribution block seals opening of said inverted U-shaped lower shim, so that, when said liquid A and said liquid B are fed into said first inlet hole and said second inlet hole respectively, said liquid A will fill said first groove and pass around said plurality of first flow distribution blocks, said liquid B will fill said second groove, enter said inlets of said plurality of distribution passages and exit from said outlets thereof, and then liquids A and B join at positions near said two legs of said plurality of first distribution blocks, forming an ABAB pattern.

The present invention also discloses a method for forming multiple stripes of repeated coating liquids composed of two materials A and B adjacent to each other on a substrate by using the die set of the present invention, said method comprising:

a) feeding said liquid A and said liquid B into said first inlet hole and said second inlet hole respectively, wherein said liquid A will fill said first groove and flow around said plurality of first flow distribution blocks, said liquid B will fill said second groove, enter said inlets of said plurality of distribution passages and exit from said outlets thereof, and then said liquids A and B join at positions near said two legs of said plurality of first distribution passages, so that a layer of stripes of repeated coating liquids A and B adjacent to each other exits from a gap at said opening of said upper shim and between said upper die and said guide shim; and b) continuously passing a substrate under said gap to allow said layer adhering to said substrate.

Preferably, in the method of the present invention said liquid A and said liquid B have viscosities which are in a ratio of A:B=1:2.55 to 2.55:1, and more preferably, A:B=1:1.6 to 1.6:1.

Preferably, in the method of the present invention said liquid A and said liquid B are fed at flow rates which are in a ratio of A:B=1:2.55 to 2.55:1, and more preferably, A:B=1:1.6 to 1.6:1.

Preferably, the method of the present invention further comprises varying the first thickness of said upper shim and the first distance of first flow distribution blocks prior to step a) so that a thickness of said layer is adjusted.

The present invention can be more fully understood by reference to the following detailed description and accompanying drawings.

DETAILED DESCRIPTION OF THE PREFERRED EMBODIMENT

The present invention discloses a die set and a method for forming a coating layer composed of two materials A, B that are arranged in adjacent stripes in an ABAB alternating pattern. The main characteristic of the present invention lies in sandwiching a guide shim with two dies, creating two chambers therebetween, so that liquid A and liquid B fed separately into the two die can join with the help from multiple distribution passages provided in the guide shim for communicating the two chambers.

Figure 1:
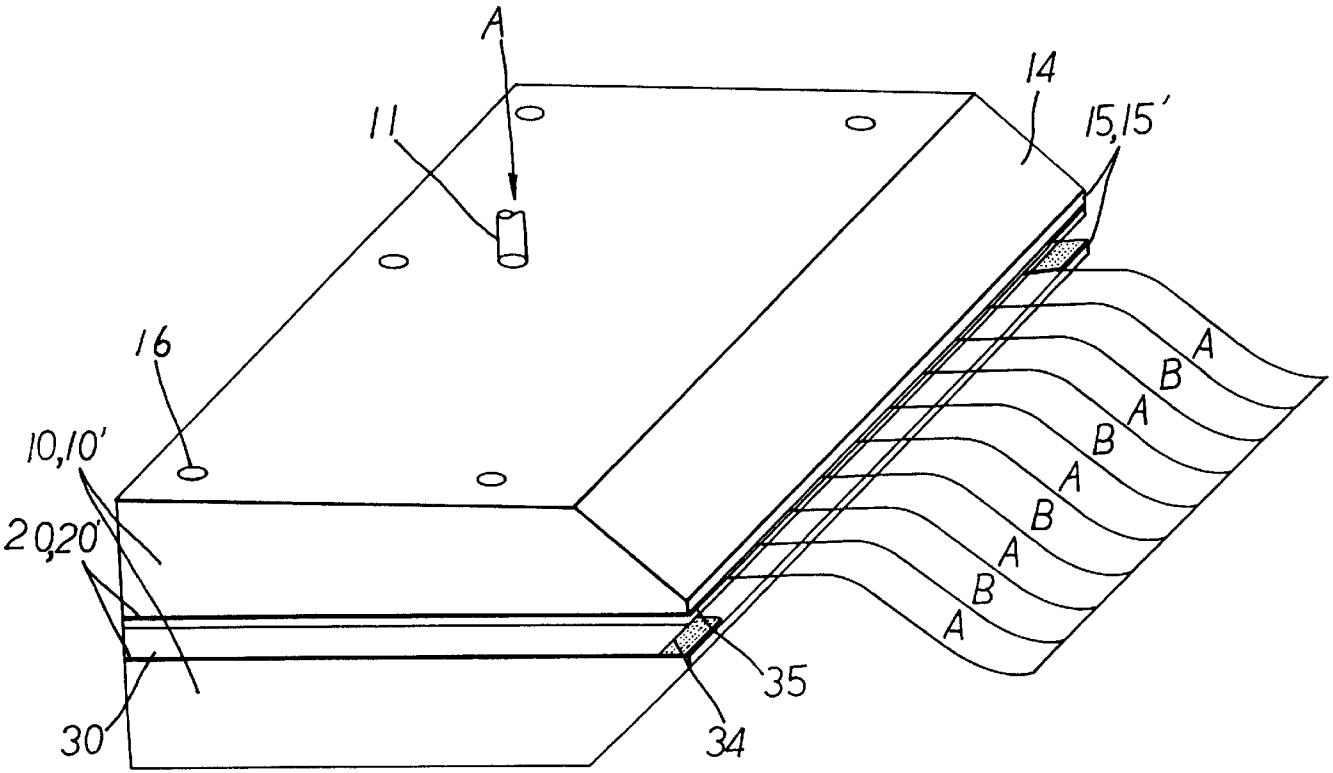
FIG. 1 is a perspective view of the die set of the present invention.
Figure 2:
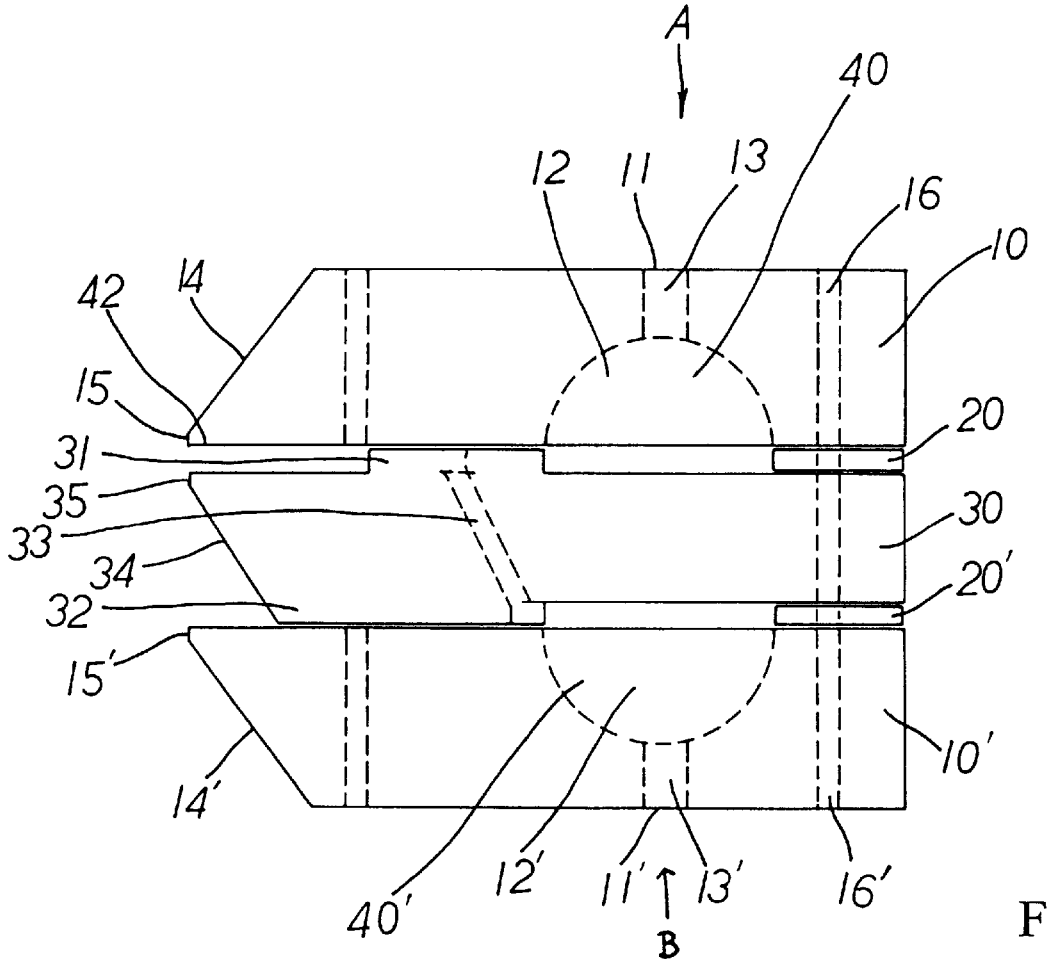
FIG. 2 is a side view of the die set of the present invention.

As shown in FIGS. 1 and 2, the die set of the present invention comprises an upper die 10 with an upper side and a lower side; a lower die 10', which is symmetric to the upper die 10 with respect to a horizontal plane between the upper and lower dies 10, 10'; an upper shim 20; a lower shim 20', which is symmetric to the upper shim 20 with respect to the horizontal plane; and a guide shim 30, mounted between the upper shim 20 and the lower shim 20'.

Figure 3:
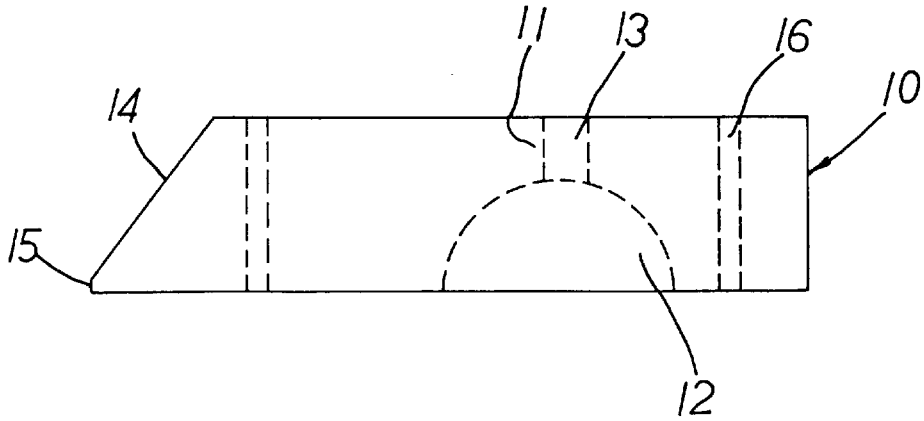
FIG. 3 is a side view of the upper die of the present invention.
Figure 4:
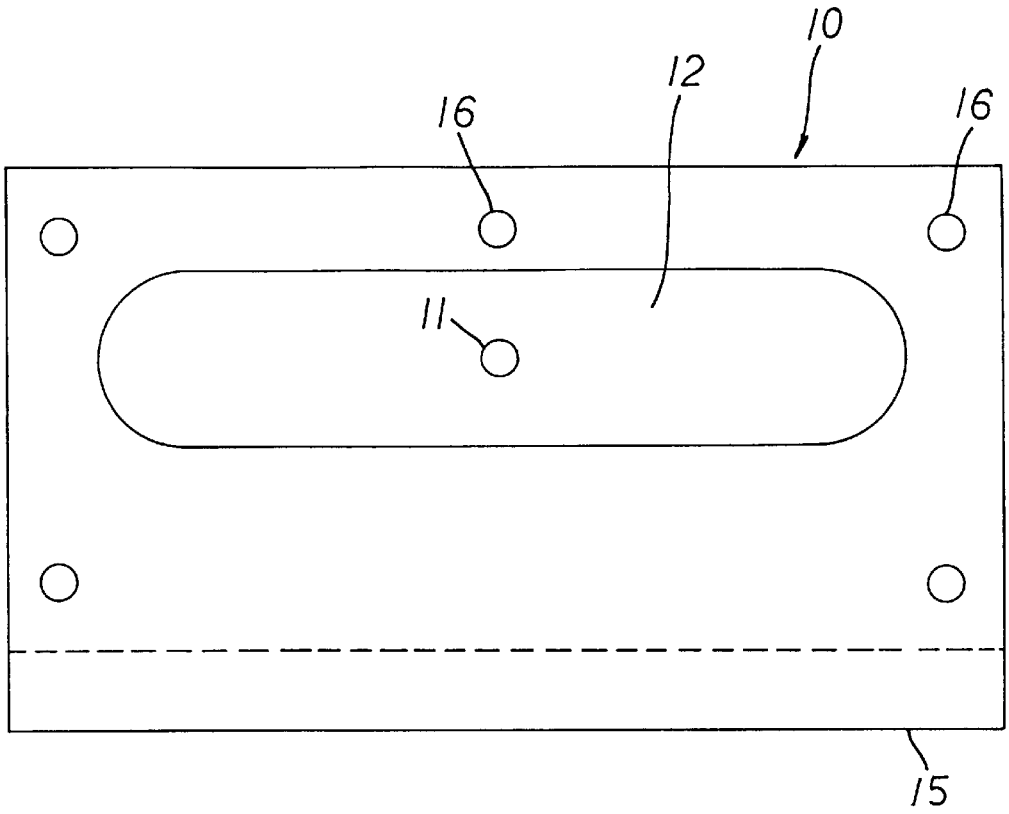
FIG. 4 is a plan view of the upper die of the present invention.

Further referring to FIGS. 3 and 4, the upper die 10 has an inlet hole 11 on the upper side thereof, a groove 12 on the lower side thereof, and a feeding passage 13 connecting the inlet hole 11 and the groove 12. The upper die 10 further has an inclined die shoulder 14 at one of its lateral sides. The die shoulder 14 has a common edge with the lower side of the upper die 10, forming an upper die lip 15. A plurality of screw holes 16 penetrating the upper die 10 from the upper side to the lower side thereof are provided for fastening. The lower die 10' has a structure which is symmetric to the upper die 10 with respect to a horizontal plane therebetween.

Figure 5:
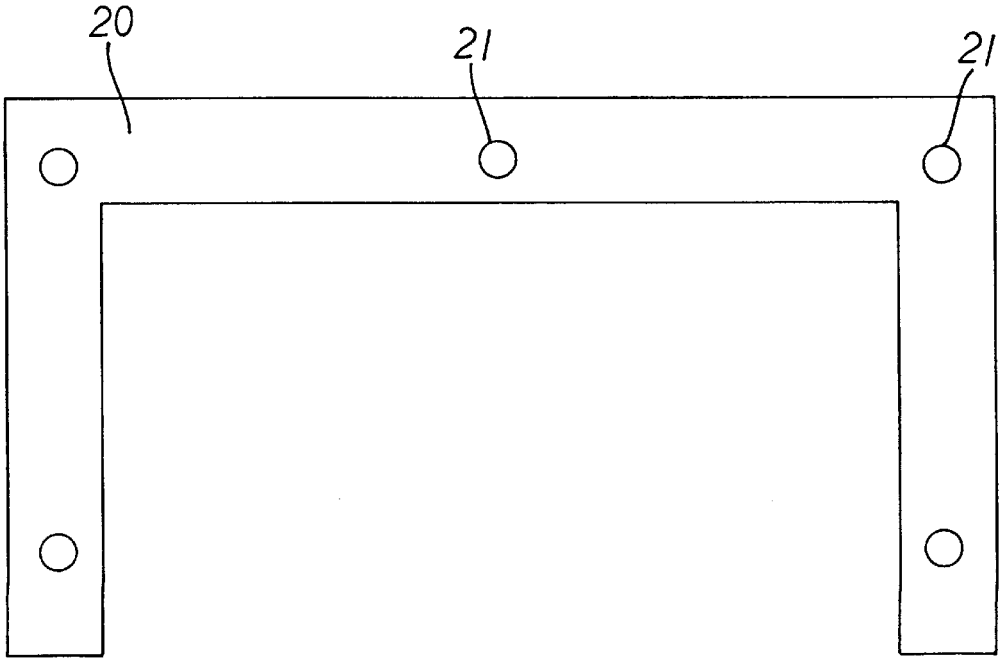
FIG. 5 is a plan view of the upper and lower shims of the present invention.

Further referring to FIG. 5, the upper shim 20 has an inverted U shape, and is provided with a plurality of threaded holes 21 corresponding to the screw holes 16, 16' of the upper and lower dies 10, 10'. The upper shim 20 is connected to the lower side of the upper die 10 at three edges which do not include the edge near the upper die lip 15.

Figure 6:
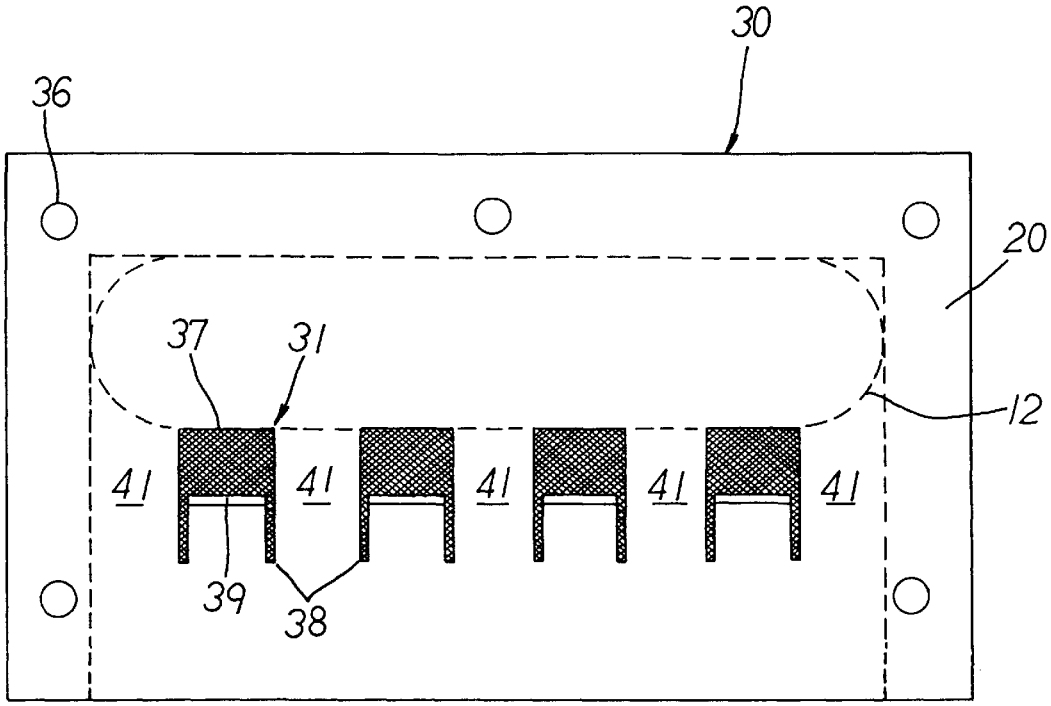
FIG. 6 is a top view of the upper side of the guide shim of the present invention.
Figure 7:
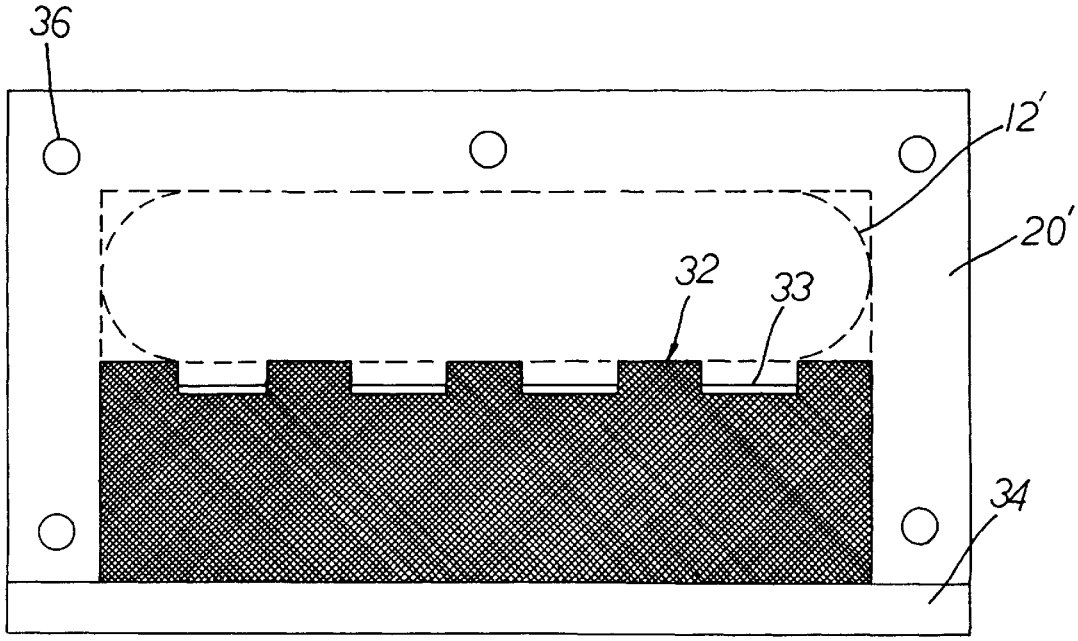
FIG. 7 is a top view of the lower side of the guide shim of the present invention.
Figure 8:
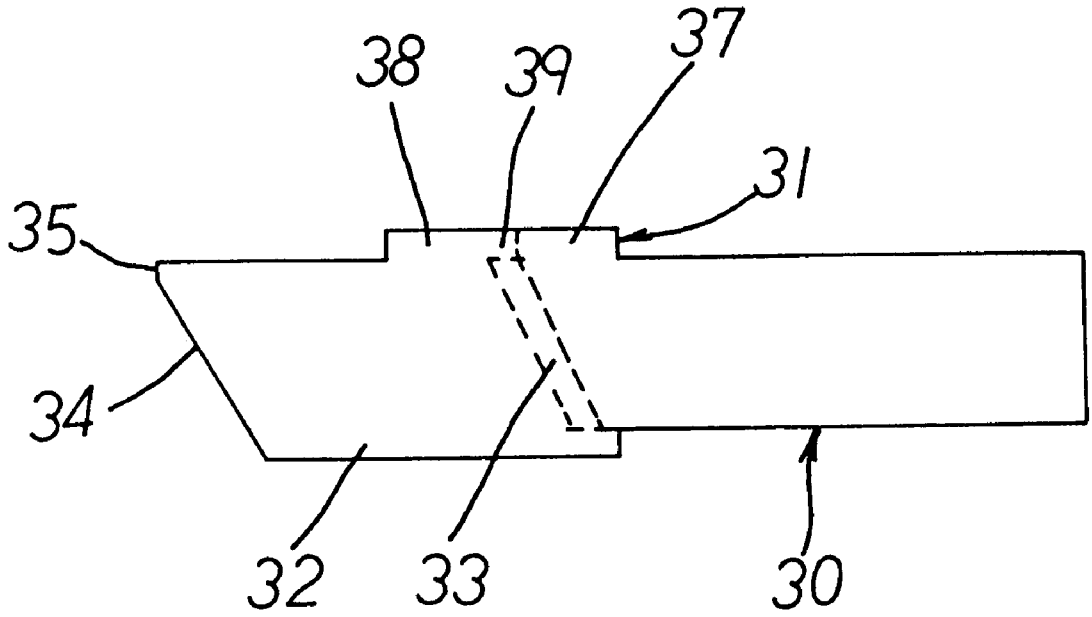
FIG. 8 is a side view of the guide shim of the present invention.

Further referring to FIGS. 6, 7 and 8, the guide shim 30 comprises four equidistant first flow distribution blocks 31 projecting from the upper side thereof, a second flow distribution blocks 32 projecting from the lower side thereof, and four distribution passages 33 formed in the guide shim for connecting the first flow distribution blocks 31 with the second flow distribution block 32, a die shoulder 34 at the inclined lateral side, and a die lip 35 at the common edge of the die shoulder 34 and the upper side thereof, and a plurality of threaded holes 36. Each of the first flow distribution blocks 31 has an inverted U shape structure having a head 37, two legs 38, and an outlet 39 of the distribution passage 33 between the two legs 38. Each of the first flow distribution blocks 31 projects from the upper side of the guide shim 30 by a distance that is equal to the thickness of the upper shim 20. Similarly, the second flow distribution block 32 projects from the lower side of the guide shim 30 by a distance that is equal to the thickness of the lower shim 20'.

The threaded holes 16, 21, 36, 21', 16' are all aligned, and the upper die 10, the upper shim 20, the guide shim 30, the lower shim 20', and the lower die 10' are fastened all together by screws (no shown in the drawings) as shown in FIG. 2. The die lips 15 and 35 form an outlet 42 of the coating layer.

As shown in FIGS. 2, 4 and 6, when the upper die 10, the upper shim 20 and the guide shim 30 are aligned and fastened together, the groove 12 of the upper die 10 is enclosed by the heads 37 of the first flow distribution blocks 31 and the upper shim 20. Between the upper die 10 and the guide shim 30, which are held apart by the upper shim 20, a first distribution chamber 40 is formed and five flow channels 41 are formed at the gaps between the upper shim 20 and the first flow distribution blocks 31. Therefore, when coating liquid A is fed through the feeding passage 13 into the first distribution chamber 40, the coating liquid A can only flow in the direction toward the first flow distribution blocks 31 and into the five flow channels 41.

Similarly, as shown in FIGS. 2 and 7, when the lower die 10', the lower shim 20' and the guide shim 30 are aligned and fastened together, the groove 12' of the lower die 10' is enclosed by the second flow distribution block 32 and the lower shim 20', so that a second distribution chamber 40' is formed. Unlike the first distribution chamber 40, the second flow distribution block 32 seals the opening of the inverted U-shaped lower shim 20', so that there is no flow channel between the lower die 10' and the lower side of the guide shim 30 for the second distribution chamber 40'. Therefore, when a coating liquid B is introduced through the feeding passage 13' into the second distribution chamber 40', the coating liquid B can only enter the four distribution passages 33 and exit from the outlets 39 of the distribution passages 39 at the first flow distribution blocks 31. Consequently, liquids A and B will join at positions near said two legs 38 of each first distribution block 31, forming a layer of an alternating ABAB pattern, and flowing out of the outlet 42.

As explained above, the upper die 10, the lower die 10' and the guide shim 30 all have die shoulders 14, 14', 34 and die lips 15, 15', 35, shown in FIG. 2. The die shoulders 14, 14', 34 and die lips 15, 15', 35 are designed to ensure a stable coating region is formed on a substrate during coating.

Embodiment: Applying the method for forming a multi-stripe coating layer of ABAB pattern Two conventional T-dies were used. An upper shim, a guide shim, and a lower shim according to the present invention were mounted between the two T-dies. A die set for forming a multi-stripe coating layer of ABAB pattern was then completed. The dimensions of the die set are listed hereinafter:

Width of the distribution passages: 0.5 mm

Length of the distribution passage: 28 mm

Diameter of grooves: 30 mm

Thickness of die lips: 1 mm

The experiments was carried out with two stages: (1) Three groups of two glycerol solutions having different viscosity were coated on a conveyer roller respectively by the die set to make sure a stable interface being formed; and (2) polyvinyl alcohol (PVA) solution is coated on a coating line directly by the die set, and left to dry.

(1) Table 1 shows data regarding the viscosity and the flow rate of said three groups of glycerol solutions. The surface tension of the coating liquids is in a range between 66–68 dyne/cm, and the density of the coating liquids is in a range between 1.21–1.22 g/cm$^3$.

TABLE 1

| Experimental Group | Viscosity (mPa's) | Flow Rate (cm3/s) |
|---|---|---|
| Group 1 (A/B) | 56/56 | 12/10 |
| Group 2 (A/B) | 56/90 | 15/12 |
| Group 3 (A/B) | 56/22 | 12/27 |

The die set used in the embodiment has four first distribution blocks so that there are five flow channels for liquid A and four distribution passages for liquid B therein. Based on the data shown in Table 1 and Hele-Shaw Model (C. A. Hieber and S. F. Shen, J. Non-Newtonian Liquid Mec., 7, 1(1980)), it is possible to correctly predict the flow rates required for the liquids A and B constituting multiple stripes under a condition of different viscosity. According to the results of the experiments, it was found that ABAB coating stripes obtained from the group 1 were straightforward and had an identical width with stable interface between the AB stripes. When the flow rate of liquid B was increased in the group 1, the coating stripes were still straightforward but different widths with stable interfaces. When ABAB stripes were formed from the coating liquids in the group 2, it shown that the interfaces between coating liquids A and B were distinct and in a stable state. When ABAB stripes were formed from the coating liquids in the group 3, it shown the interfaces between coating liquids A and B were slightly ambiguous. It may be resulted from the liquid of low viscosity overflowing to the liquid of high viscosity. A ratio of viscosity of the liquid A to that of the liquid B is 2.55 in the group 3 case.

(2) Based on the results of the stage (1), the same die set was used to coat 6 wt % PVA aqueous solutions on a polyethylene terephthalate (PET) substrate on a coating line, and the coating layer was left to dry on the coating line. Both coating liquids A and B had the same properties, wherein the viscosity, the density, and the surface tension were 245 mPa S, 1.01 g/cm$^3$, and 38.1 dyne/cm, respectively. The flow rate at the inlet for liquids A and B were 2.5 cm$^3$/s and 2 cm$^3$/s, respectively. The coating speed is 2 m/min. The results of the experiments shown that a coating layer of multi-stripe in ABAB pattern was formed on the substrate

What is claimed is:

1. A die set for forming multiple stripes of repeated coating liquids composed of two materials A and B adjacent to each other, said die set comprising:

an upper die having a first groove formed on a lower horizontal plane thereof, and a first inlet hole formed at a location other than said lower horizontal plane thereof for introducing said liquid A from outside into said first groove;

an inverted U-shaped upper shim having a first thickness;

an inverted U-shaped lower shim having a second thickness;

a guide shim having an upper side and a lower side, which are parallel to a horizontal plane, further comprising a plurality of spaced first flow distribution blocks, projecting from said upper side by a first distance that is equal to said first thickness of said upper shim, each of said plurality of first flow distribution blocks being of an inverted U shape with a head and two legs, a second flow distribution block projecting from said lower side of said guide shim by a second distance that is equal to said second thickness of said lower shim, and a plurality of distribution passages, each of said plurality of distribution passages connecting said lower side and said upper side of said guide shim, and an outlet of said distribution passage being located between said two legs of said first flow distribution block and an inlet of said distribution passage being adjacent to said second flow distribution block; and a lower die having a second groove formed on an upper horizontal plane thereof, and a second inlet hole formed at a location other than said upper horizontal plane thereof for introducing said liquid B from outside into said second groove;

wherein said upper die, said upper shim, said guide shim, said lower shim and said lower die are assembled in sequence, so that said upper shim is between said lower horizontal plane of said upper die and said upper side of said guide shim, and said lower shim is between said upper horizontal plane of said lower die and said lower side of said guide shim; wherein said first groove of said upper die and said plurality of first flow distribution blocks are enclosed by said inverted U-shaped upper shim, and said second groove of said lower die is enclosed by said inverted U-shaped lower shim; wherein openings of said inverted U shapes of said plurality of first flow distribution blocks face toward the same direction of opening of said inverted U-shaped upper shim, and said second flow distribution block seals opening of said inverted U-shaped lower shim, so that, when said liquid A and said liquid B are fed into said first inlet hole and said second inlet hole respectively, said liquid A will fill said first groove and pass around said plurality of first flow distribution blocks, said liquid B will fill said second groove, enter said inlets of said plurality of distribution passages and exit from said outlets thereof, and then liquids A and B join at positions near said two legs of said plurality of first distribution blocks, forming an ABAB pattern.

2. A method for forming multiple stripes of repeated coating liquids composed of two materials A and B adjacent to each other on a substrate by using the die set according to claim 1, said method comprising the following steps:

a) feeding said liquid A and said liquid B into said first inlet hole and said second inlet hole respectively, wherein said liquid A will fill said first groove and flow around said plurality of first flow distribution blocks, said liquid B will fill said second groove, enter said inlets of said plurality of distribution passages and exit from said outlets thereof, and then said liquids A and B join at positions near said two legs of said plurality of first distribution passages, so that a layer of stripes of repeated coating liquids A and B adjacent to each other exits from a gap at said opening of said upper shim and between said upper die and said guide shim; and b) continuously passing a substrate under said gap to allow said layer to adhere to said substrate.

3. The method according to claim 2, wherein said liquid A and said liquid B have viscosities which are in a ratio of A:B=1:2.55 to 2.55:1.

4. The method according to claim 2, wherein said liquid A and said liquid B have viscosities which are in a ratio of A:B=1:1.6 to 1.6:1.

5. The method according to claim 2, wherein said Liquid A and said liquid B are fed at flow rates which are in a ratio of A:B=1:2.55 to 2.55:1.

6. The method according to claim 2, wherein said liquid A and said liquid B are fed at flow rates which are in a ratio of A:B=1:1.6 to 1.6:1.

7. The method according to claim 2 further comprising varying the first thickness of said upper shim and the first distance of first flow distribution blocks prior to step a) so that a thickness of said layer is adjusted.

* * * * *